US010558142B2

(12) United States Patent
Matsumoto et al.

(10) Patent No.: US 10,558,142 B2
(45) Date of Patent: Feb. 11, 2020

(54) POWDER STORAGE CONTAINER AND IMAGE FORMING APPARATUS

(71) Applicants: Kazuki Matsumoto, Kanagawa (JP); Emi Kita, Kanagawa (JP); Kenji Nakamura, Kanagawa (JP); Minoru Toyoda, Kanagawa (JP)

(72) Inventors: Kazuki Matsumoto, Kanagawa (JP); Emi Kita, Kanagawa (JP); Kenji Nakamura, Kanagawa (JP); Minoru Toyoda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/956,033

(22) Filed: Apr. 18, 2018

(65) Prior Publication Data

US 2018/0356748 A1 Dec. 13, 2018

(30) Foreign Application Priority Data

Jun. 12, 2017 (JP) ..... 2017-115166

(51) Int. Cl.
*G03G 15/08* (2006.01)

(52) U.S. Cl.
CPC ..... *G03G 15/0863* (2013.01); *G03G 15/0849* (2013.01); *G03G 15/0856* (2013.01); *G03G 15/0865* (2013.01); *G03G 15/0872* (2013.01); *G03G 15/0889* (2013.01); *G03G 15/0891* (2013.01); *G03G 2215/0604* (2013.01)

(58) Field of Classification Search
None
See application file for complete search history.

(56) References Cited

U.S. PATENT DOCUMENTS

2007/0147898 A1* 6/2007 Miyata ..... G03G 21/105 399/253
2009/0016777 A1 1/2009 Miyamoto et al.
2012/0189326 A1 7/2012 Yoshida et al.
2013/0028638 A1 1/2013 Tsuritani et al.
2013/0183065 A1 7/2013 Nakamura et al.
2013/0259532 A1* 10/2013 Kubota ..... G03G 21/1676 399/254

(Continued)

FOREIGN PATENT DOCUMENTS

JP 2013-160795 8/2013
JP 2013-161091 8/2013

*Primary Examiner* — Victor Verbitsky
(74) *Attorney, Agent, or Firm* — Harness, Dickey & Pierce, P.L.C.

(57) ABSTRACT

A powder storage container is provided. The powder storage container includes a container body, a discharge port, a conveyer, a stirrer, a return port, and a partition wall. The container body is configured to contain powder. The powder contained in the container body is dischargeable through the discharge port. The conveyer is configured to convey the powder to the discharge port. The stirrer is configured to stir the powder contained in the container body by rotating. The return port is disposed outside a rotational locus of the stirrer in a radial direction, and the powder conveyed by the conveyer is returnable through the return port toward the stirrer. The partition wall is disposed between the stirrer and the return port with at least a part of the partition wall positioned above the return port.

19 Claims, 12 Drawing Sheets

(56) References Cited

U.S. PATENT DOCUMENTS

| | | | |
|---|---|---|---|
| 2013/0266347 | A1 | 10/2013 | Kubota et al. |
| 2014/0153972 | A1 | 6/2014 | Tsuritani et al. |
| 2014/0294449 | A1 | 10/2014 | Kubota et al. |
| 2014/0356004 | A1 | 12/2014 | Tsuritani et al. |
| 2016/0004208 | A1 | 1/2016 | Kubota et al. |
| 2016/0139540 | A1 | 5/2016 | Kubota et al. |
| 2016/0299455 | A1 | 10/2016 | Tsuritani et al. |
| 2017/0248870 | A1 | 8/2017 | Kubota et al. |
| 2018/0074452 | A1 | 3/2018 | Toyoda et al. |

* cited by examiner

POWDER STORAGE CONTAINER AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2017-115166, filed on Jun. 12, 2017, in the Japan Patent Office, the entire disclosure of which is hereby incorporated by reference herein.

BACKGROUND

Technical Field

The present disclosure relates to a powder storage container and an image forming apparatus.

Description of the Related Art

As a powder storage container to accommodate powder, for example, for an image forming apparatus such as a photocopier and a printer, a toner cartridge is used that accommodate toner (as powder) for image forming.

A toner cartridge is generally configured to be replaceable with a new one when toner stored therein is consumed. Some toner cartridges include a conveyer, such as a screw, that conveys the stored toner toward a discharge port.

The use of the toner cartridge of this kind may endanger a user at a risk of inadvertently touching a driver such as a gear to drive the conveyer during replacement. If the conveyer is driven to convey toner while the discharge port is closed, the toner may be compressed into a block or the conveyer may be deformed under load.

In attempting to solve such a problem, a toner cartridge including a return port has been proposed, through which the toner in a conveyance space is returned to the storage container. In this toner cartridge, even when the user inadvertently drives the conveyer, the conveyed toner can be returned through the return port, thereby suppressing compression of toner and reducing load to the conveyer.

SUMMARY

In accordance with some embodiments of the present invention, a powder storage container is provided. The powder storage container includes a container body, a discharge port, a conveyer, a stirrer, a return port, and a partition wall. The container body is configured to contain powder. The powder contained in the container body is dischargeable through the discharge port. The conveyer is configured to convey the powder to the discharge port. The stirrer is configured to stir the powder contained in the container body by rotating. The return port is disposed outside a rotational locus of the stirrer in a radial direction, and the powder conveyed by the conveyer is returnable through the return port toward the stirrer. The partition wall is disposed between the stirrer and the return port with at least a part of the partition wall positioned above the return port.

In accordance with some embodiments of the present invention, an image forming apparatus is provided. The image forming apparatus includes the above-described powder storage container containing a toner as the powder and a developing device to develop an electrostatic latent image into a toner image with the toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
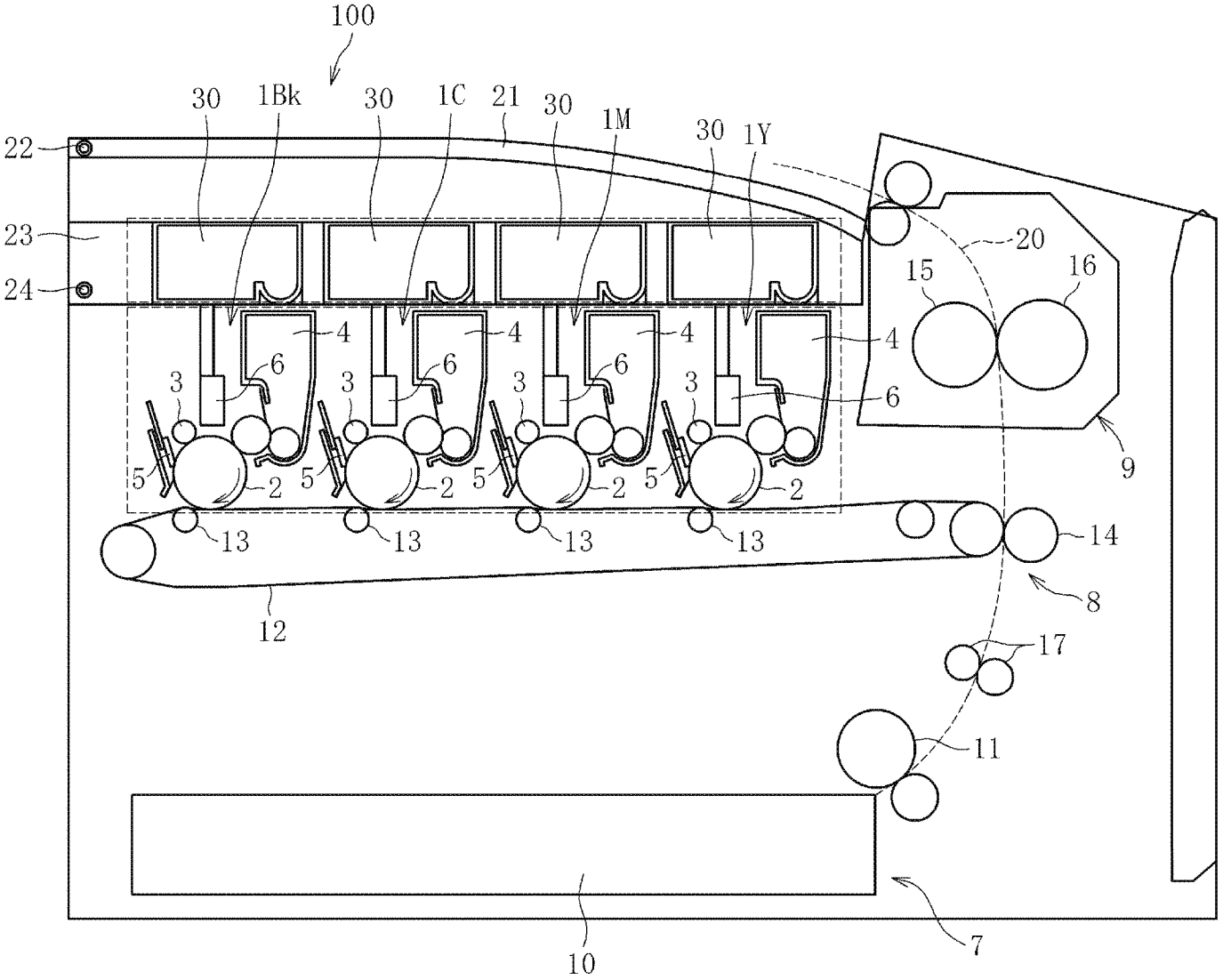
FIG. 1 is a schematic view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

In the above-described conventional toner cartridge having the return port, there may be a case in which the toner stirred by a stirrer is conveyed to the return port side. In this case, the toner may fall down to the outside through the return port via the discharge port and toner supply amount is thereby temporarily increased, resulting in fluctuation of toner supply speed. Moreover, toner to be returned from the return port may be pushed back by the above toner, causing toner accumulation within the toner cartridge. As a result, residual toner remaining inside the toner cartridge is generated.

In accordance with an embodiment of the present invention, a toner cartridge is provided within which toner is smoothly circulated. This is achieved by provision of a partition wall between the stirrer and the return port, so that the powder stirred by the stirrer is suppressed from being conveyed to the return port side and also toner supply speed is suppressed from fluctuating.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

FIG. 1 is a schematic view of an image forming apparatus according to an embodiment of the present invention.

In the present disclosure, image forming apparatus refers to printer, copier, facsimile machine, or multifunctional peripheral having these functions.

An image forming apparatus 100 illustrated in FIG. 1 is a multicolor image forming apparatus including four image forming units 1Y, 1M, 1C, and 1Bk detachably mounted on the image forming apparatus body. Embodiments of the present invention provide either a multicolor image forming apparatus or a monochrome image forming apparatus. The image forming units 1Y, 1M, 1C, and 1Bk have the same configuration except for containing different color developers, i.e., yellow (Y), magenta (M), cyan (C), and black (Bk) toners, respectively, corresponding to decomposed color separation components of full-color images.

More specifically, each of the image forming units 1Y, 1M, 1C, and 1Bk includes: a photoconductor 2 in a drum-like shape serving as an image bearer; a charger 3 to charge a surface of the photoconductor 2; a developing device 4 configured to form a toner image by supplying toner, serving as a powder, to a surface of the photoconductor 2; and a cleaner 5 to clean the surface of the photoconductor 2.

The image forming apparatus 100 further includes: irradiators 6 to irradiate surfaces of respective photoconductors 2 to form electrostatic latent images; a sheet feeder 7 to feed a sheet serving as a recording medium; a transfer device 8 to transfer a toner image formed on each photoconductor 2 onto the sheet; and a fixing device 9 to fix the toner image transferred onto the sheet.

The sheet feeder 7 includes a sheet tray 10 and a sheet feed roller 11 to feed sheets from the sheet tray 10.

The transfer device 8 includes: an intermediate transfer belt 12 in the form of an endless belt stretched taut with multiple rollers, serving as an intermediate transferor; four primary transfer rollers 13 each serving as a primary transferor to transfer a toner image formed on each photoconductor 2 onto the intermediate transfer belt 12; and a secondary transfer roller 14 serving as a secondary transferor to transfer the toner image transferred onto the intermediate transfer belt 12 onto a sheet. The primary transfer rollers 13 are in contact with the respective photoconductors 2 via the intermediate transfer belt 12. The intermediate transfer belt 12 is thereby in contact with the photoconductors 2, thus forming primary transfer nips therebetween. The secondary transfer roller 14 is in contact with one of the multiple rollers stretching the intermediate transfer belt 12 via the intermediate transfer belt 12. The secondary transfer roller 14 and the intermediate transfer belt 12 thereby form a secondary transfer nip therebetween.

The fixing device 9 includes a fixing roller 15 serving as a fixing member and a pressure roller 16 serving as a pressure member. The fixing roller 15 is heated by a heater (e.g., halogen heater) to fix an image on a sheet. The pressure roller 16 is pressed against the fixing roller 15. The fixing roller 15 and the pressure roller 16 are in contact with each other, thus forming a fixing nip therebetween.

In the image forming apparatus 100, a sheet conveyance path 20 is formed through which a sheet fed from the sheet tray 10 is conveyed. A timing roller pair 17 is disposed on the sheet conveyance path 20 on the way from the sheet feed roller 11 to the secondary transfer nip (secondary transfer roller 14).

An image forming operation performed by the above-described image forming apparatus is described below with reference to FIG. 1.

As an image forming operation start is instructed, the photoconductors 2 are each driven to rotate clockwise in FIG. 1 and the surfaces thereof are uniformly charged to a high potential by the respective chargers 3. The surfaces of the photoconductors 2 are irradiated by the respective irradiators 6 based on image information of a document read by a document reading device or print information instructed by a terminal. The potential of the irradiated portion is thereby reduced and an electrostatic latent image is formed. The electrostatic latent image is supplied with toner from each developing device 4 and a toner image is thereby formed on each photoconductor 2.

The toner images formed on the respective photoconductors 2 are successively transferred onto the intermediate transfer belt 12 so as to overlap each other at the primary transfer nip. Thus, a full-color (four-color) toner image is formed on the intermediate transfer belt 12. The toner image formed on the intermediate transfer belt 12 is transferred onto a sheet at the secondary transfer nip.

The sheet is fed from the sheet feeder 7. In the sheet feeder 7, the sheet feed roller 11 feeds sheets from the sheet tray 10 one by one, and the timing roller pair 17 conveys the fed sheet to the secondary transfer nip in synchronization with an entry of the toner image formed on the intermediate transfer belt 12 into the secondary transfer nip.

The sheet having the transferred toner image thereon is conveyed to the fixing device 9. The fixing roller 15 and the pressure roller 16 apply heat and pressure to the toner image, thereby fixing the toner image on the sheet. The sheet is ejected to the outside of the image forming apparatus.

The above description refers to an image forming operation for forming a full-color image on a sheet. The image forming apparatus is also capable of forming a single-color image by operating only one of the four image forming units, or a two-color or three-color image by operating two or three of the four image forming units, respectively.

Referring to FIG. 1, a cover 21 that is openable and closable is disposed at an upper part of the image forming apparatus 100. The cover 21 is configured to be openable and closable in the vertical direction by revolving about a support shaft 22 horizontally disposed in the apparatus body. Between the cover 21 and the image forming units 1Y, 1M, 1C, and 1Bk, a container holder 23 holding multiple toner cartridges 30, each serving as a powder storage container, is disposed. The container holder 23 is configured to revolve about a support shaft 24 horizontally disposed in the apparatus body.

Figure 2:
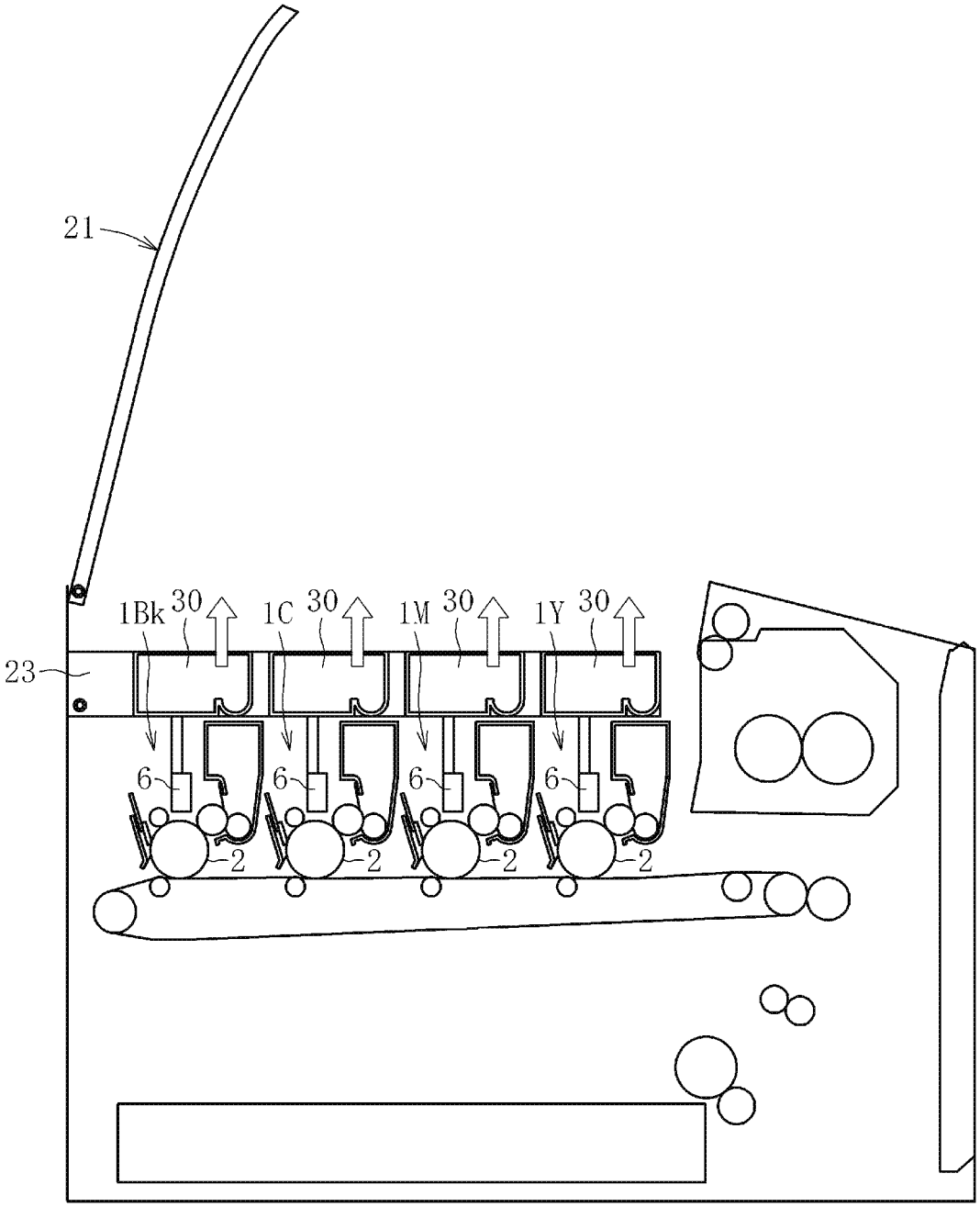
FIG. 2 is a schematic view of the image forming apparatus illustrated in FIG. 1 in a state in which a cover is opened.

Referring to FIG. 2, as the cover 21 is revolved upward, an upper part of the apparatus body is opened. By thus opening the upper part of the apparatus body, it becomes possible for the user to work for attachment or detachment of the toner cartridges 30 to or from the container holder 23 from the upper part of the apparatus body.

Figure 3:
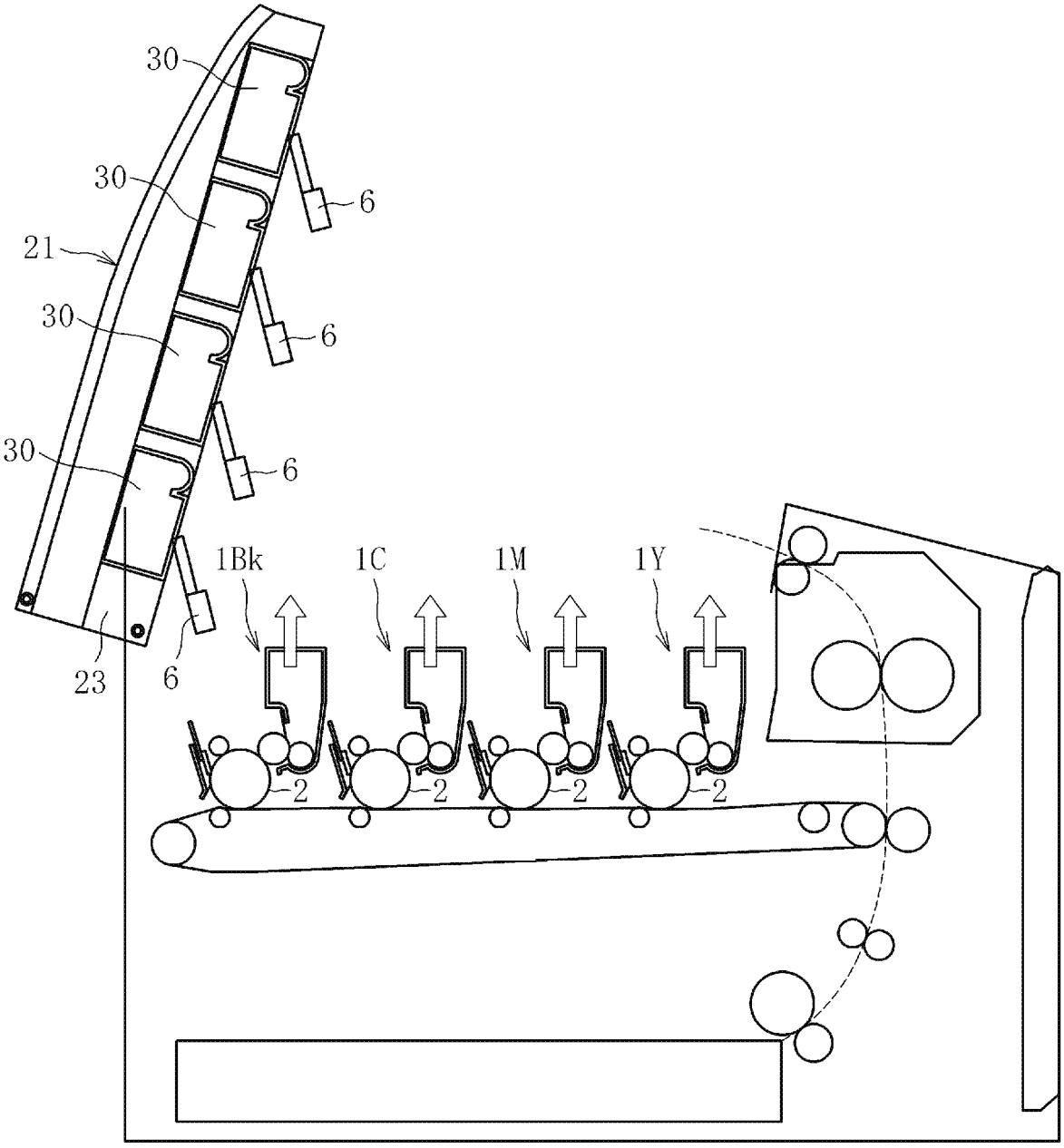
FIG. 3 is a schematic view of the image forming apparatus illustrated in FIG. 1 in a state in which a container holder is revolved upward.

Referring to FIG. 3, as the container holder 23 is revolved upward, the container holder 23 (together with the toner cartridges 30) is retreated from the vicinity of upper parts of the image forming units 1Y, 1M, 1C, and 1Bk. As the container holder 23 is thus retreated, the irradiators 6 are also retreated from the vicinity of upper parts of the photoconductors 2 since the irradiators 6 are suspended from lower parts of the container holder 23. Thus, it becomes possible for the user to work for attachment or detachment of the image forming units 1Y, 1M, 1C, and 1Bk from the upper part of the apparatus body. Since the multiple toner cartridges 30 can be retreated at once by just revolving the container holder 23, it is possible for the user to work for attachment or detachment of the image forming units 1Y, 1M, 1C, and 1Bk with high efficiency without independently removing the toner cartridges 30.

A specific configuration of the toner cartridge 30 is described below.

Multiple (four, in the above-described image forming apparatus) toner cartridges 30, disposed corresponding to multiple developing devices 4, respectively contain toners having the same color as the toner contained in the corresponding developing device 4. The multiple toner cartridges 30 have the same configuration except for containing different color toners. Therefore, the configuration of one the toner cartridges 30 will be explained below as an example.

Figure 4:
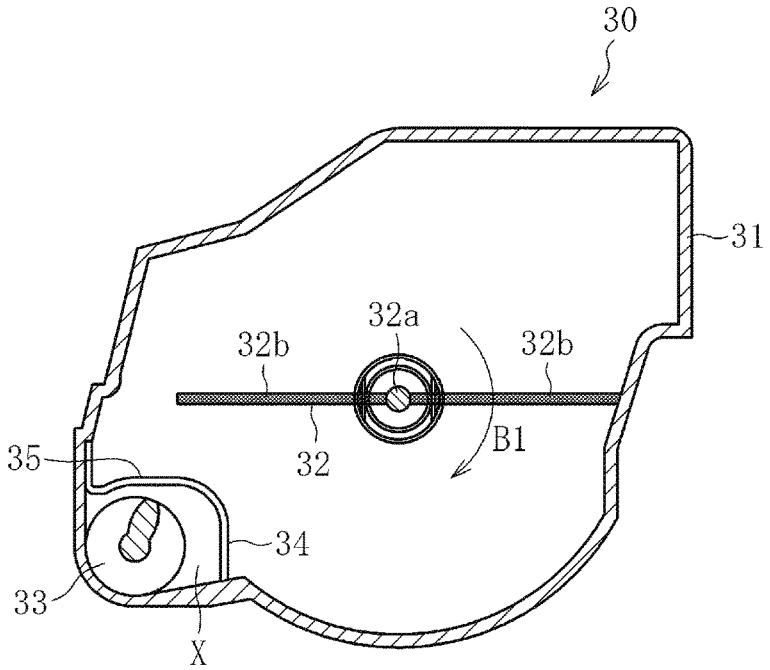
FIG. 4 RELATED ART
FIG. 4 is a cross-sectional view of a related-art toner cartridge.
Figure 5:
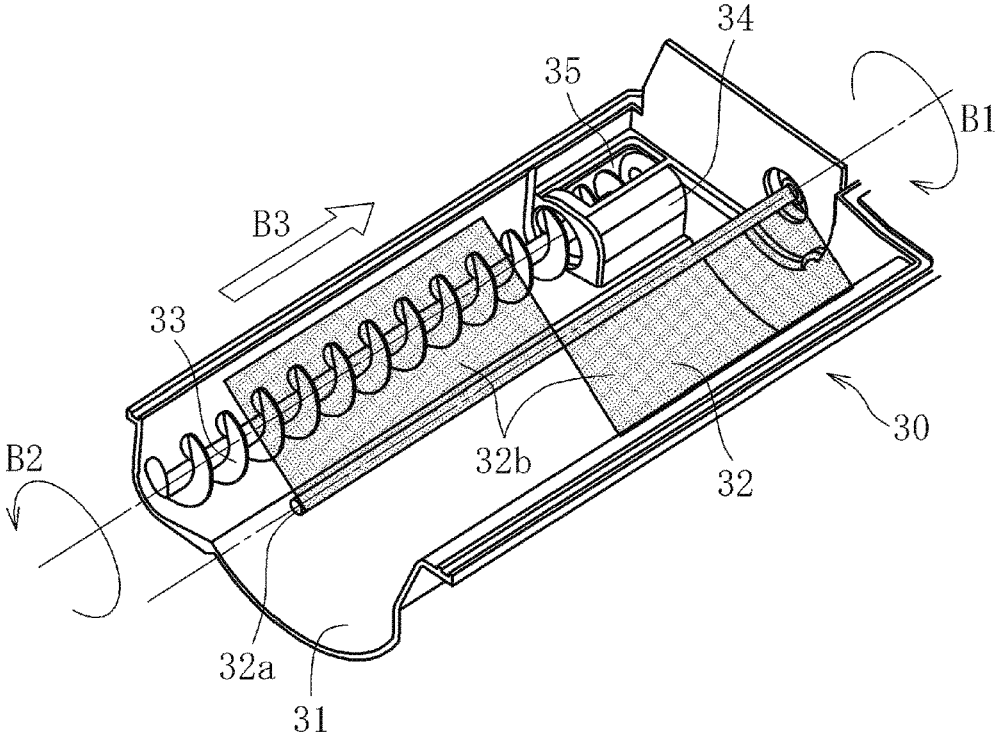
FIG. 5 RELATED ART
FIG. 5 is a perspective view illustrating an interior configuration a related-art toner cartridge.

FIG. 4 is a cross-sectional view of the toner cartridge 30. FIG. 5 is a perspective view illustrating an interior configuration of the toner cartridge 30.

As illustrated in FIGS. 4 and 5, the toner cartridge 30 includes a container body 31 to store toner therein. Inside the container body 31, a stirrer 32 to stir toner inside the container body 31, a conveying screw 33 to convey the toner, and a divider 34 are disposed.

The stirrer 32 is made of a resin material or a flexible material. The stirrer 32 has a shaft 32*a* and two stirring blades 32*b*. The stirring blades 32*b* extend in opposite directions relative to the radial direction of their rotational locus around the shaft 32*a*. One end (i.e., an end opposite to the shaft 32*a*) of each stirring blade 32*b* comes into contact with the container body 31. It is possible that only one of the stirring blades 32*b* is configured to come into contact with the container body 31. It is also possible that the stirrer 32 has only one stirring blade 32*b*.

As a driving force is transmitted from a driving source to the stirrer 32, the two stirring blades 32*b* start rotating about the shaft 32*a* in a direction indicated by arrow B1 in FIGS. 4 and 5. Toner inside the container body 31 is thereby stirred and conveyed toward the conveying screw 33 side.

The divider 34 divides between the stirrer 32 and the conveying screw 33. A cross-sectional surface of the divider 34 is formed into an arc. As illustrated in FIG. 4, a space X is formed inside the container body 31 between the arc-like inner circumferential surface of the divider 34 and the opposed inner circumferential surface of the container body 31.

As illustrated in FIG. 5, the conveying screw 33 is driven to rotate in a direction indicated by arrow 132 and the toner is thereby conveyed in a direction indicated by arrow B3.

The downstream end of the conveying screw 33 relative to the toner conveyance direction (indicated by arrow B3) is inserted into the space X formed inside the divider 34. Thus, the toner conveyed by the conveying screw 33 is conveyed to the space X.

On an upper part of the divider 34, a return port 35 for returning toner to the stirrer 32 side is disposed. The return port 35 is disposed outside the rotational locus of the stirrer 32 in the radial direction.

Figure 6:
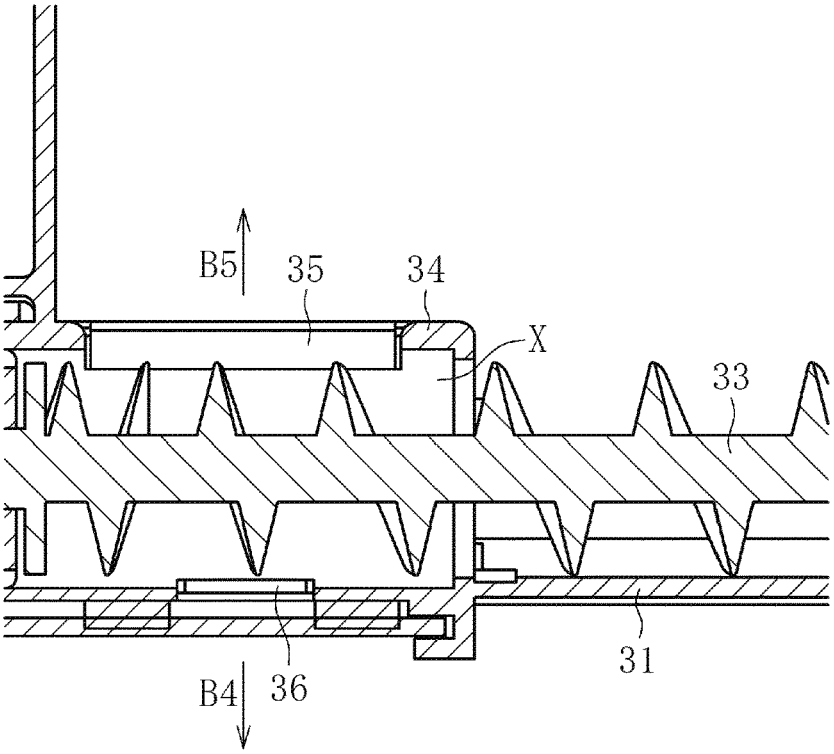
FIG. 6 is a cross-sectional view illustrating an interior configuration of a divider.

Referring to FIG. 6, a discharge port 36 through which toner is discharged to the outside is disposed on a portion of the container body 31 where the space X is formed. The discharge port 36 is disposed on a lower side of the container body 31 relative to a direction of gravitational force in a state in which the toner cartridge 30 is mounted on the image forming apparatus placed on a horizontal plane (hereinafter simply "direction of gravitational force"). The discharge port 36 is openable and closable by a shutter member. In the embodiment illustrated in FIG. 6, two shutter members are disposed. FIG. 6 illustrates a state in which the discharge port 36 is closed by the shutter members. On each shutter member, an open hole is disposed. The discharge port 36 is opened to exterior when the shutter members are operated in such a manner that the discharge port 36 and the two open holes are communicated with each other.

The return port 35 and the discharge port 36 are respectively opened to upper and lower sides in the direction of gravitational force. In the embodiment illustrated in FIG. 6, the discharge port 36 is disposed facing a part of the return port 35. In other words, the discharge port 36 is disposed overlapping the return port 35 when viewed from the direction of gravitational force.

At the time when toner is supplied from the toner cartridge 30 to the developing device 4 (illustrated in FIG. 1), the discharge port 36 is opened to communicate with the developing device 4, the conveying screw 33 is driven to convey toner inside the container body 31 to the space X, and part of the toner is discharged from the discharge port 36 to the developing device 4 (as indicated by arrow B4 in FIG. 6).

Part of the toner conveyed by the conveying screw 33 to the space X is returned to the stirrer 32 side through the return port 35 disposed on an upper side of the space X in the direction of gravitational force (as indicated by arrow B5 in FIG. 6). Accordingly, toner is circulated within the container body 31 while being prevented from being excessively conveyed to the space X, clogging the space X, or being condensed in the space X.

Figure 7:
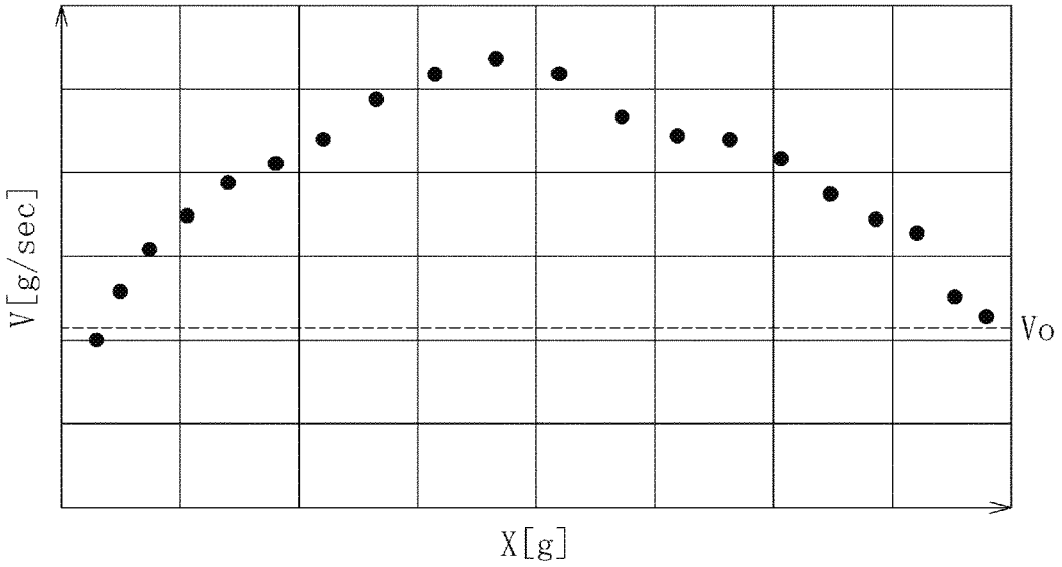
FIG. 7 RELATED ART
FIG. 7 is a graph illustrating a transitional change of toner supply speed against a change in toner remaining amount in a related-art toner cartridge.

FIG. 7 is a graph illustrating an experimental result in measuring a relation between toner supply speed V (g/sec) and remaining toner amount X (g) in the toner cartridge 30 having the configuration illustrated in FIGS. 4 to 6. The amount of toner discharged from the discharge port 36 was measured while the toner cartridge 30 containing a predetermined amount of toner is driven for a predetermined period of time.

In FIG. 7, the horizontal axis denotes remaining toner amount X and the vertical axis denotes toner supply speed V. The right side of the graph indicates the greater remaining toner amount X. In other words, the right side of the graph indicates the results in the initial stage of the experiment, and the left side thereof indicates the results after toner has been consumed with progress of the experiment.

As illustrated in FIG. 7, the toner supply speed V shows a close value to a target supply speed Vo immediately after toner supply is started, but thereafter gradually increases to cause a large deviation from the target supply speed Vo. As the remaining toner amount X further decreases, the toner supply speed V approaches the target supply speed Vo again.

In the present case in which the toner supply speed V cannot be remained constant to cause a large deviation from the target supply speed Vo, a problem may occur, such as blurred image and damaged developing device, due to short of toner.

A main reason why the toner supply speed cannot be remained constant in the toner cartridge 30 is considered as follows. As the toner cartridge 30 starts driving, the stirrer 32 (illustrated in FIG. 5) starts rotating to stir the toner stored in the container body 31. At this time, part of the stirred toner is conveyed to the return port 35 side and accumulates in the vicinity of the return port 35. As the accumulated toner reached a certain amount, the toner falls into the space X from the return port 35 and part thereof is discharged from the discharge port 36 to the outside. This leads to a temporal increase of the amount of toner discharged from the discharge port 36 as well as the toner supply amount.

Such a problem of temporal increase of toner supply speed easily occur in a case in which the return port 35 and the discharge port 36 are disposed facing each other, as illustrated in FIG. 6, because toner fallen into the space X from the return port 35 is directly discharged from the discharge port 36 to the outside.

Figure 8:
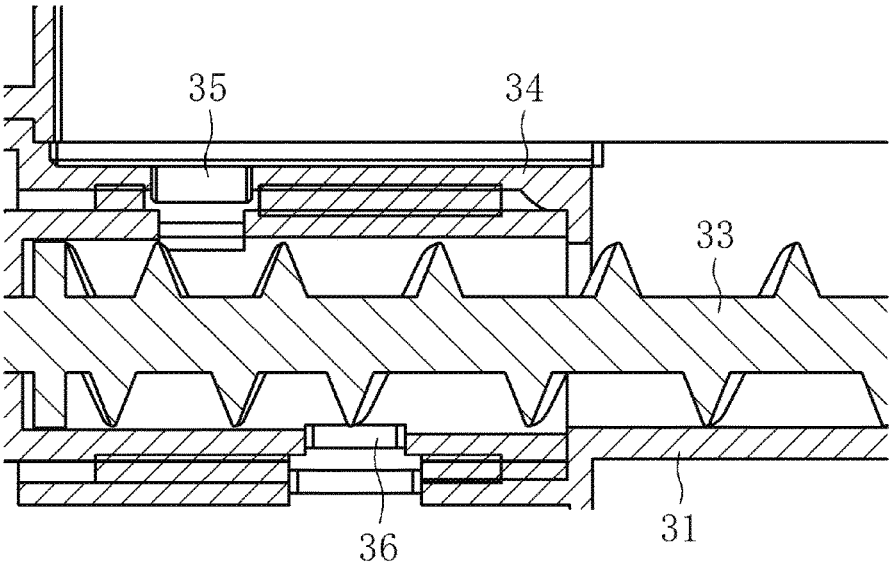
FIG. 8 is a cross-sectional view illustrating an interior configuration of a divider.

On the other hand, it is possible that the return port 35 and the discharge port 36 are disposed so as not to face each other, as illustrated in FIG. 8. In this case, however, the return port 35 is limited in its installation range. There may arise a problem when the return port 35 is designed large, for example, for handling toner having low fluidity.

In addition, as the toner stirred by the stirrer 32 is conveyed to the return port 35 side, toner to be conveyed from the space X to the return port 35 is pushed back, thereby preventing smooth circulation of toner within the toner cartridge 30.

This problem can be solved by the below-described toner cartridge according to some embodiments of the present invention that is capable of preventing toner from falling from the stirrer 32 into the space X through the return port 35.

Figure 9:
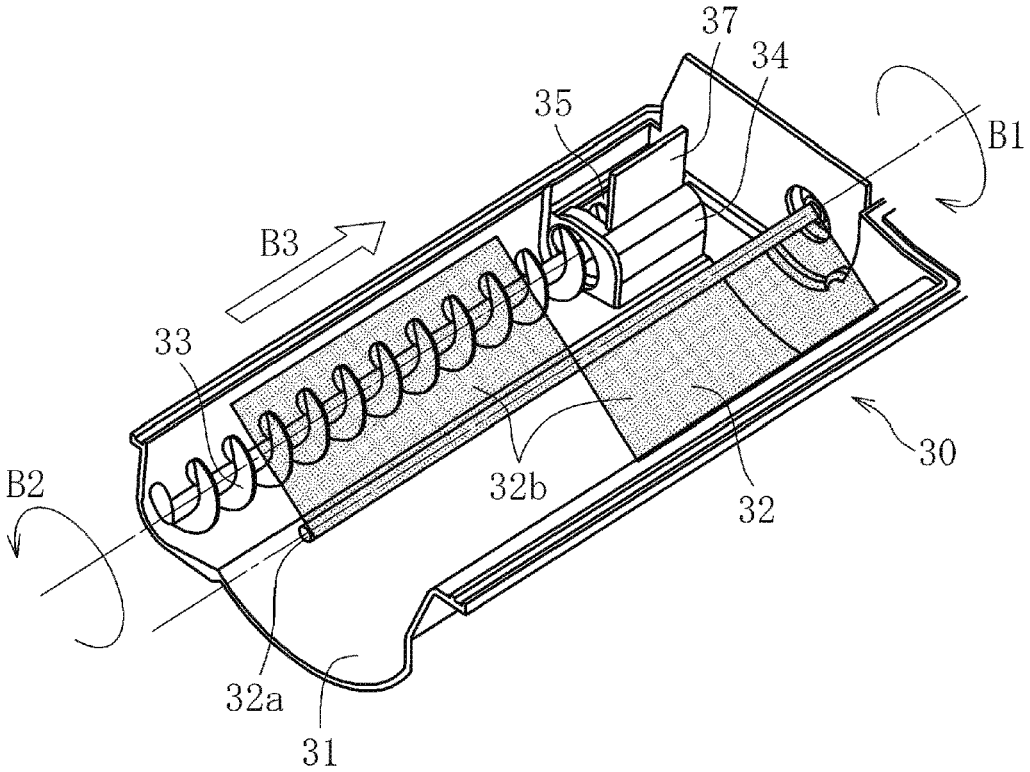
FIG. 9 is a perspective view illustrating an interior configuration a toner cartridge according to an embodiment of the present invention.

Referring to FIG. 9, in the toner cartridge 30 according to an embodiment of the present invention, a partition wall 37 is disposed between the stirrer 32 and the return port 35. The partition wall 37 is a platy member extending upward (i.e., in a direction opposite to the direction of gravitational force) from the divider 34.

The partition wall 37 prevents the toner stirred by the stirrer 32 and moved to the return port 35 side from being conveyed to the return port 35.

Figure 10:
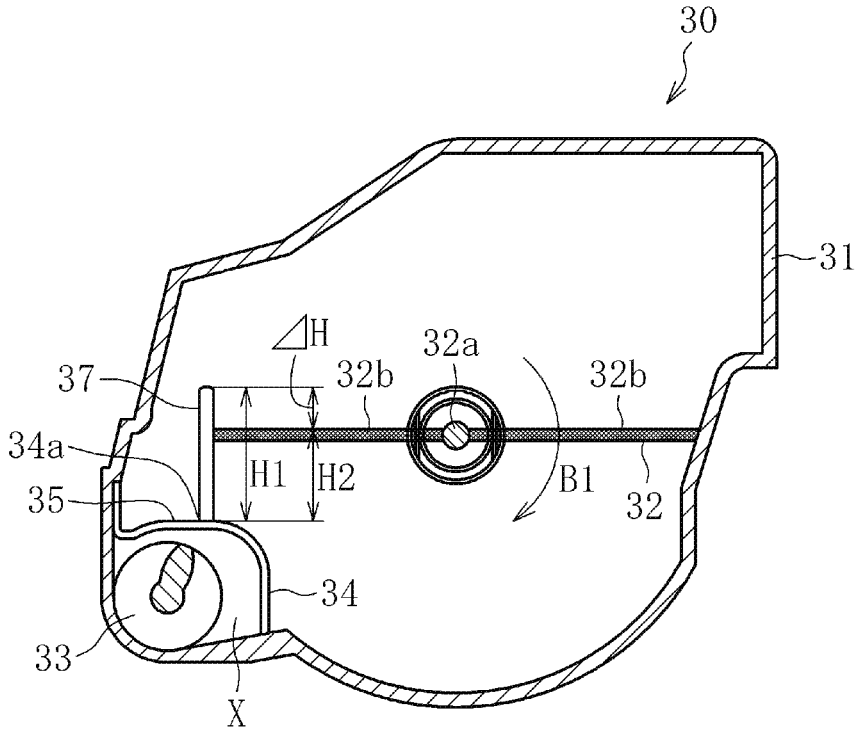
FIG. 10 is a cross-sectional view of a toner cartridge according to an embodiment of the present invention.
Figure 11A:
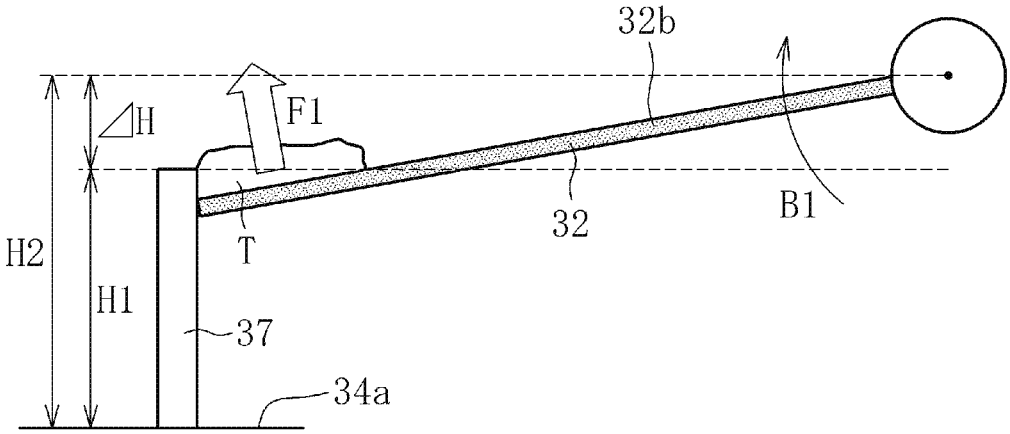
FIGS. 11A and 11B are illustrations for explaining a situation where toner is stirred by a stirrer.
Figure 11B:
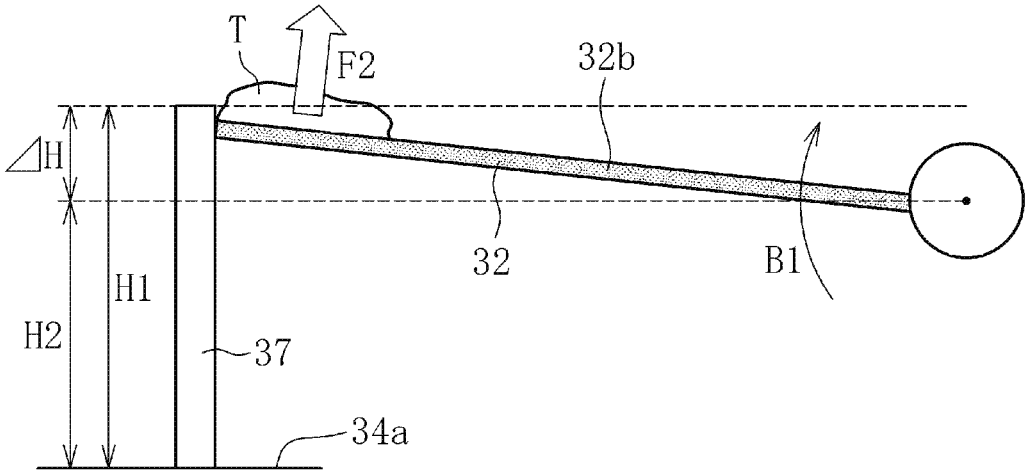

As illustrated in FIG. 10, the partition wall 37 extending upward from an upper surface 34*a* of the divider 34 has a height H1 that is greater than a vertical distance H2 between the upper surface 34*a* of the divider 34 and the rotational axis of the stirrer 32. This configuration suppresses toner from getting over the partition wall 37 and being conveyed to the return port 35 side. In a case in which the height H1 of the partition wall 37 is smaller than the vertical distance H2, as illustrated in FIG. 11A, at the time when the stirring blade 32*b* holding toner T thereon passes above the partition wall 37 by rotation of the stirrer 32, a force F1 is applied to the toner T in a direction that the toner gets over the partition wall 37. By contrast, in a case in which the height H1 of the partition wall 37 is greater than the vertical distance H2 in accordance with an embodiment of the present invention, as illustrated in FIG. 11A, at the time when the stirring blade 32*b* holding toner T thereon passes above the partition wall 37, a force F2 is applied to the toner T in a direction opposite to a direction that the toner gets over the partition wall 37. By setting the height H1 of the partition wall 37 greater than the vertical distance H2, the toner T stirred by the stirrer 32 is prevented from being conveyed to the return port 35 side.

As illustrated in FIG. 9, the partition wall 37 is extending upward and, when viewed from the direction of gravitational force, is not overlapped with the return port 35. Due to such a shape of the partition wall 37, it is possible to set the draft direction of the mold of the partition wall 37 and that of the container body 31 to the same direction, allowing an integral molding of the partition wall 37 with the container body 31.

Figure 12A:
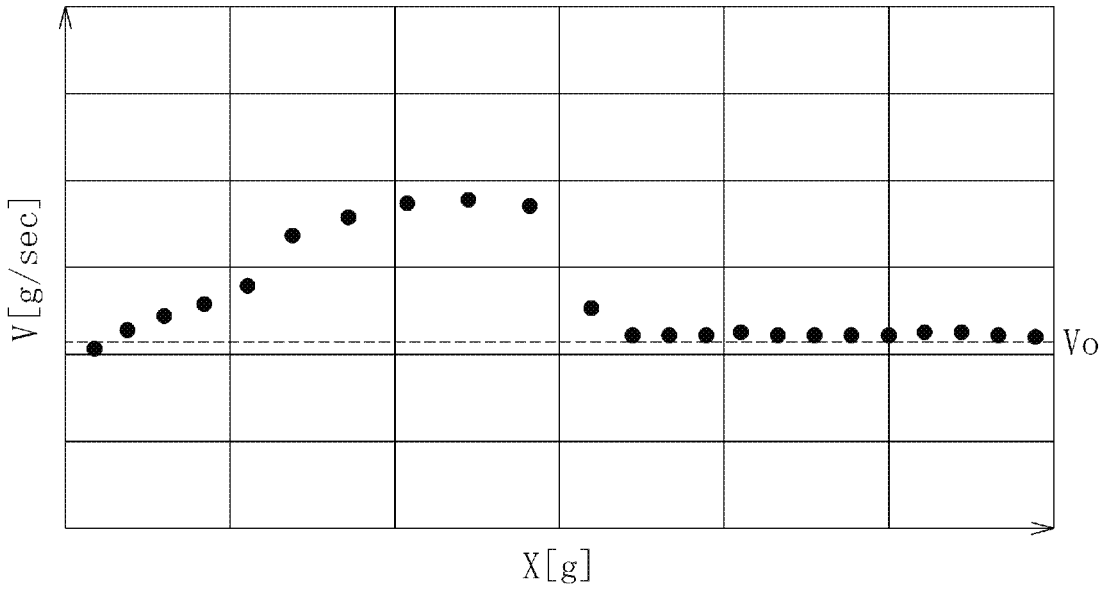
FIGS. 12A and 12B are graphs each illustrating a transitional change of toner supply speed against a change in toner remaining amount in a toner cartridge according to an embodiment of the present invention.

A relation between toner supply speed V (g/sec) and remaining toner amount X (g) in the toner cartridge 30 having the above-described configuration is measured. FIGS. 12A and 12 B are graphs illustrating the results obtained using partition walls satisfying H1<H2 and H1>H2, respectively.

When a partition wall satisfying H1<H2 is used, as illustrated in FIG. 12A, the toner supply speed V is kept constant at around the target supply speed Vo for a certain period of time from start of toner supply, but is thereafter temporarily increased. In this case using a partition wall having a height smaller than the vertical distance H2, a certain amount of toner is effectively prevented from being conveyed from the stirrer 32 to the return port 35. However, since part of the toner gets over the partition wall 37 and is conveyed to the return port 35 side, continuous supply of toner may result in accumulation of toner in the vicinity of the return port 35 and falling of the toner from the discharge port 36, thereby increasing toner supply speed.

Figure 12B:
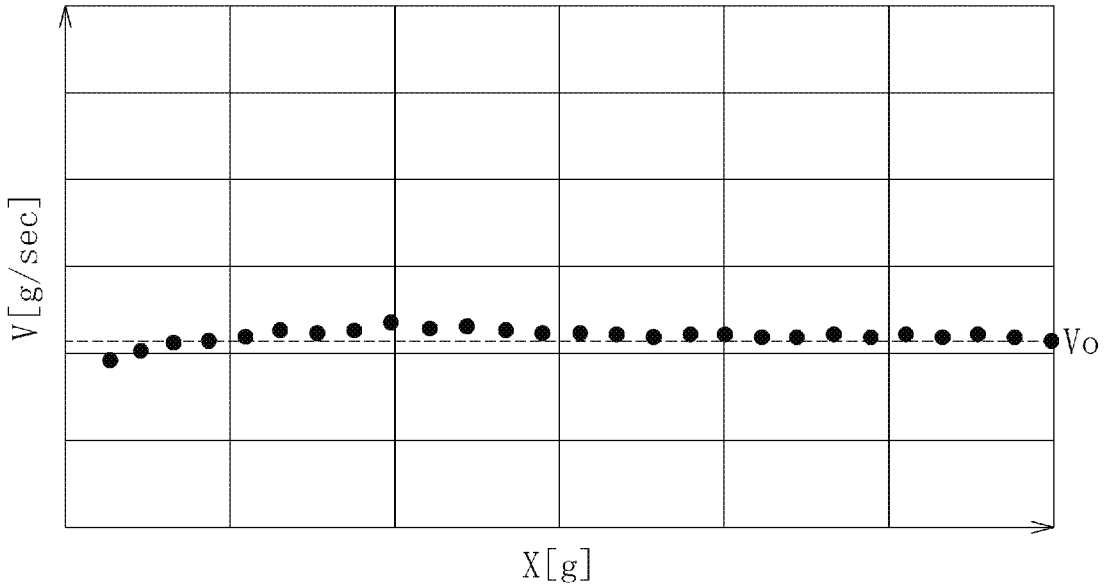

By contrast, when a partition wall satisfying H1>H2 is used, as illustrated in FIG. 12B, the toner supply speed V is kept almost constant from start to end of the measurement. This indicates that the toner is prevented from being conveyed from the stirrer 32 to the return port 35.

In summary, even when a partition wall having a height H1 smaller than the vertical distance H2 is used, a certain amount of toner is effectively prevented from being conveyed from the stirrer 32 to the return port 35. When a partition wall having a height H1 greater than the vertical distance H2 is used, toner is more reliably prevented from being conveyed from the stirrer 32 to the return port 35. According to the present embodiment, the partition wall 37 suppresses the toner stirred by the stirrer 32 from being conveyed to the return port 35 side. Accordingly, toner supply speed from the toner cartridge 30 to the outside is suppressed from fluctuating and toner is smoothly circulated within the toner cartridge 30.

A partition wall according to another embodiment is described below.

Figure 13:
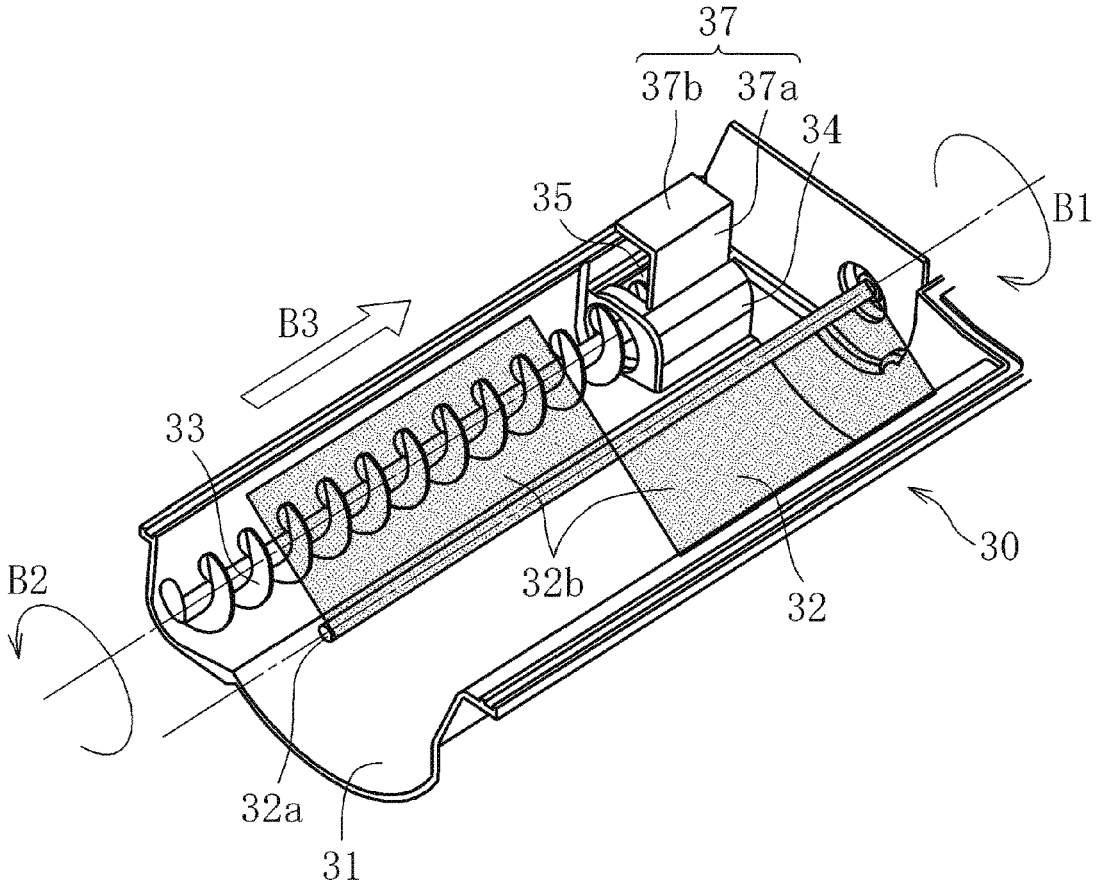
FIG. 13 is a perspective view illustrating an interior configuration a toner cartridge according to an embodiment of the present invention.
Figure 14:
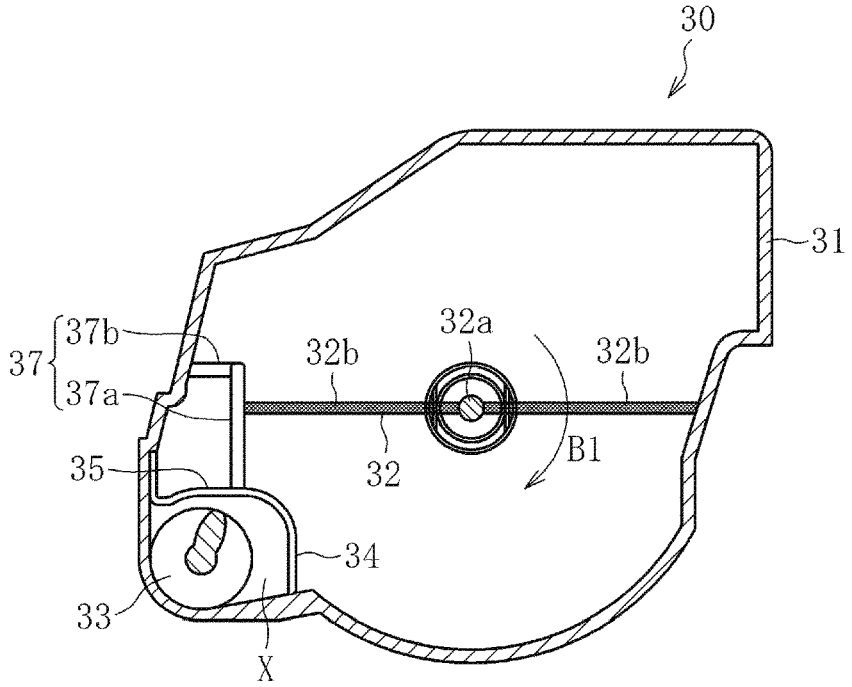
FIG. 14 is a cross-sectional view of a toner cartridge according to an embodiment of the present invention.

As illustrated in FIGS. 13 and 14, the partition wall 37 may include a first partition wall portion 37*a* extending upward (i.e., in a direction opposite to the direction of gravitational force and coincident with the height direction of the partition wall 37) and a second partition wall portion 37*b* continuously disposed at an upper end of the first partition wall portion 37*a*. The second partition wall portion 37*b* extends in a horizontal direction so as to cover the return port 35 from above.

According to the present embodiment, even when the toner stirred by the stirrer 32 gets over the first partition wall portion 37*a*, the second partition wall portion 37*b* prevents the toner from moving to the return port 35 side. Accordingly, even when the height H1 of the partition wall 37 is smaller than the vertical distance 112, the toner stirred by the stirrer 32 and moved to the return port 35 side is more reliably prevented from being conveyed to the return port 35.

Figure 15:
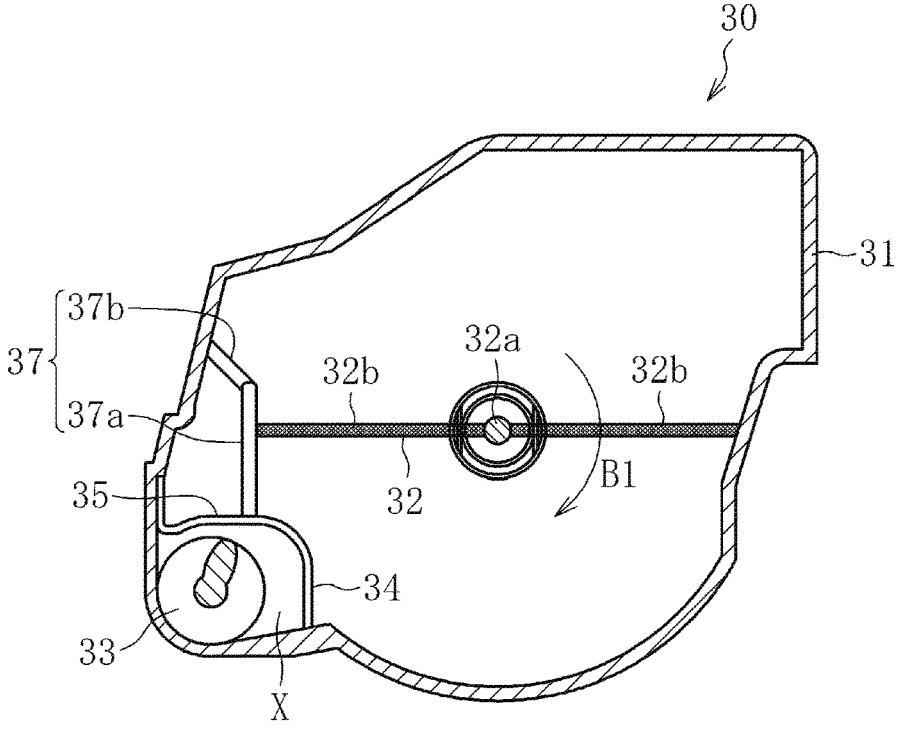
FIG. 15 is a cross-sectional view of a toner cartridge according to an embodiment of the present invention.

It is also possible that the second partition wall portion 37*b* is formed as an inclined surface inclined downward toward the stirrer 32 side, as illustrated in FIG. 15. In other words, the second partition wall portion 37*b* may be formed as an inclined surface continuously disposed at an upper end of the first partition wall portion 37*a* and inclined upward from the stirrer 32 side toward the return port 35 side.

According to the present embodiment, the toner gotten over the first partition wall portion 37*a* is not only prevented from being conveyed to the return port 35 side by the second partition wall portion 37*b* but also suppressed from accumulating on the second partition wall portion 37*b*, leading to effective utilization of toner within the toner cartridge 30.

Figure 16:
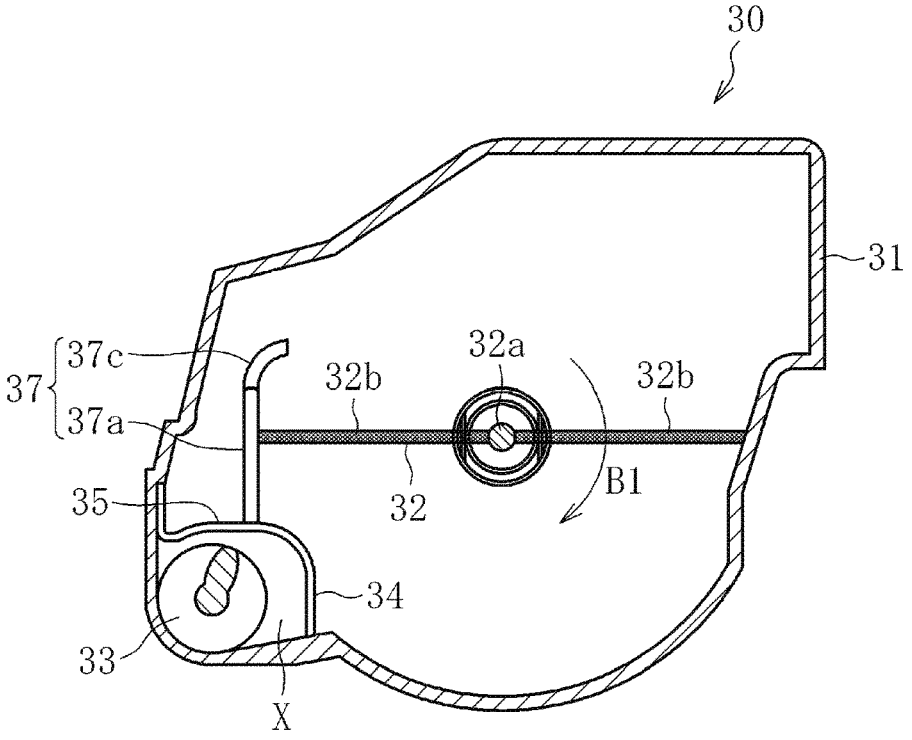
FIG. 16 is a cross-sectional view of a toner cartridge according to an embodiment of the present invention.
Figure 17:
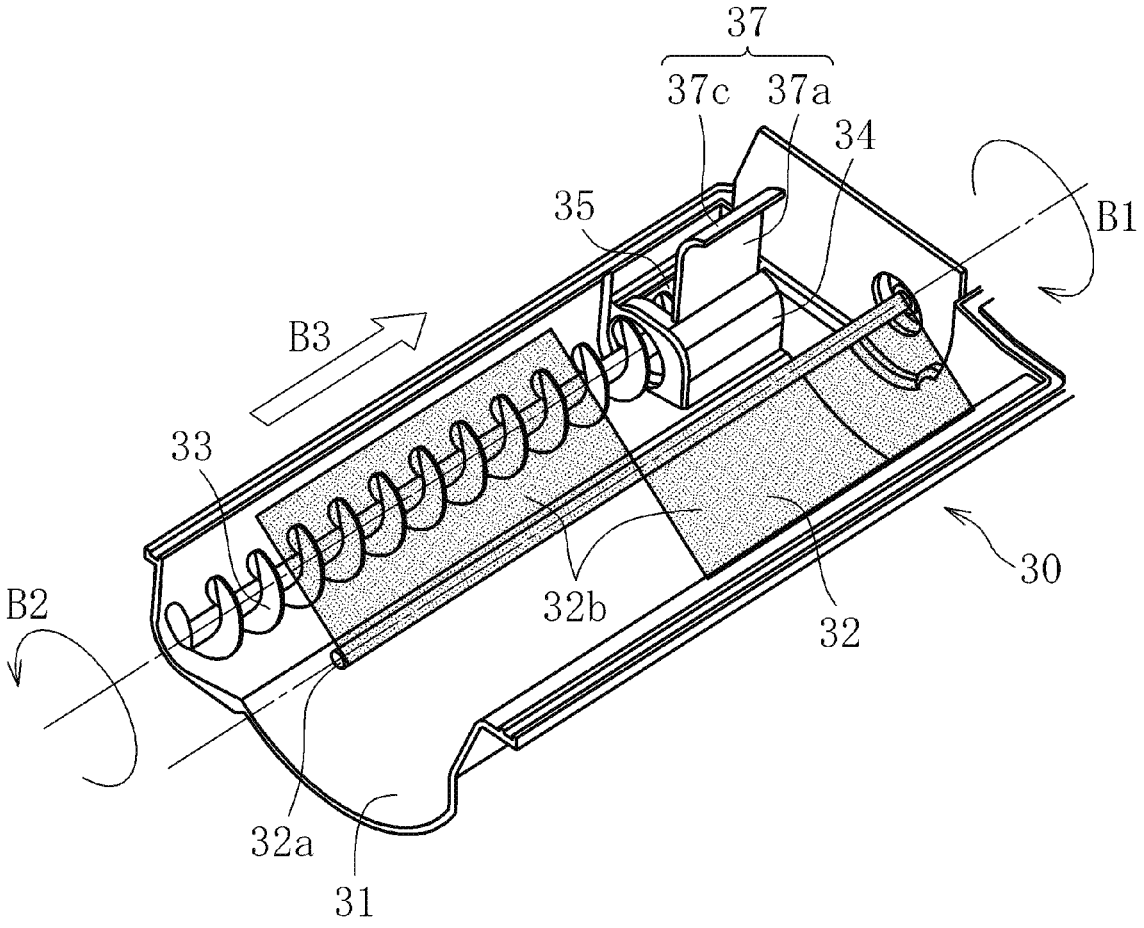
FIG. 17 is a perspective view illustrating an interior configuration a toner cartridge according to an embodiment of the present invention.

It is also possible that a return portion 37*c* that is curved toward the stirrer 32 side is disposed at an end of the first partition wall portion 37*a*, as illustrated in FIGS. 16 and 17. The return portion 37*c* is formed into an arc along the rotational locus of one end of the stirring blade 32*b*. The stirring blades 32*b*, having flexibility, rotate along the arc surface of the return portion 37*c*. According to this embodiment, the toner stirred by the stirrer 32 is more reliably prevented from getting over the partition wall 37.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A powder storage container comprising:

a container body configured to contain powder;

a discharge port, the powder contained in the container body being dischargeable through the discharge port;

a conveying screw, configured to convey the powder to the discharge port upon being driven;

a stirrer, including a shaft portion and a blade portion, configured to stir the powder contained in the container body upon being rotated;

a return port, disposed outside a rotational locus of the stirrer in a radial direction, the powder conveyed by the conveying screw being returnable toward the stirrer through the return port; and a partition wall, disposed between the stirrer and the return port, at least a part of the partition wall being attached to and extending beyond the return port from a divider wall, disposed between the conveying screw and the stirrer.

2. The powder storage container of claim 1, wherein the return port is an opening in the divider wall.

3. The powder storage container of claim 1, wherein the discharge port and the return port at least partially face each of another of the return port and the discharge port.

4. The powder storage container of claim 1, wherein at least the part of the partition wall, attached to and extending beyond the return port from the divider wall disposed between the conveying screw and the stirrer, has a height relatively greater than a height of a rotational axis of the stirrer.

5. The powder storage container of claim 1, wherein the container body and the partition wall are integrally molded.

6. The powder storage container of claim 1, wherein the partition wall includes:

a first partition wall portion, attached to and extending outward from the divider wall disposed between the conveying screw and the stirrer; and a second partition wall portion, disposed at an upper end of the first partition wall portion and extending in a direction covering the return port.

7. The powder storage container of claim 6, wherein the second partition wall portion includes an inclined surface, inclined toward the stirrer.

8. The powder storage container of claim 1, wherein the partition wall includes:

a first partition wall portion, attached to and extending outward from the divider wall disposed between the conveying screw and the stirrer; and a return portion, disposed at an upper end of the first partition wall portion and curved toward the stirrer.

9. The powder storage container of claim 8, wherein the return portion is formed into an arc along a rotational locus of the stirrer.

10. An image forming apparatus comprising:

the powder storage container of claim 1 containing a toner as the powder; and a developing device to develop an electrostatic latent image into a toner image using the toner.

11. The powder storage container of claim 1, wherein at least the part of the partition wall, being attached to and extending beyond the return port from the divider wall disposed between the conveying screw and the stirrer, is configured to suppress at least a portion of the powder, being stirred by the stirrer, from being conveyed to the return port.

12. The powder storage container of claim 1, wherein at least the part of the partition wall being attached to and extending outward from the divider wall disposed between the conveying screw and the stirrer, at least partially partitions the return port and the stirrer.

13. The powder storage container of claim 11, wherein at least the part of the partition wall being attached to and extending outward from the divider wall disposed between the conveying screw and the stirrer, at least partially partitions the return port and the stirrer.

14. The powder storage container of claim 10, wherein at least the part of the partition wall, being attached to and extending beyond the return port from the divider wall disposed between the conveying screw and the stirrer, is configured to suppress at least a portion of the powder, being stirred by the stirrer, from being conveyed to the return port.

15. The powder storage container of claim 10, wherein at least the part of the partition wall being attached to and extending outward from the divider wall disposed between the conveying screw and the stirrer, at least partially partitions the return port and the stirrer.

16. The powder storage container of claim 6, wherein at least one of the first partition wall portion and the second partition wall portion, is configured to suppress at least a portion of the powder, being stirred by the stirrer, from being conveyed to the return port.

17. The powder storage container of claim 6, wherein at least one of the first partition wall portion and the second partition wall portion, at least partially partitions the return port and the stirrer.

18. The powder storage container of claim 8, wherein at least one of the first partition wall portion and the return portion, is configured to suppress at least a portion of the powder, being stirred by the stirrer, from being conveyed to the return port.

19. The powder storage container of claim 8, wherein at least one of the first partition wall portion and the return portion, at least partially partitions the return port and the stirrer.

* * * * *